US005992316A

United States Patent [19]

Komata et al.

[11] Patent Number: 5,992,316

[45] Date of Patent: Nov. 30, 1999

[54] STENCIL SHEET UNIT AND METHOD OF MAKING PRINT STENCIL USING THE SAME

[75] Inventors: Satoru Komata; Fumiko Koyama, both of Ibaraki, Japan

[73] Assignee: Riso Kagaku Corporation, Tokyo, Japan

[21] Appl. No.: 09/050,253

[22] Filed: Mar. 30, 1998

[30] Foreign Application Priority Data

Sep. 28, 1997 [JP] Japan ..... 9-77357

[51] Int. Cl.[6] ..... B41N 1/24

[52] U.S. Cl. ..... 101/128.21; 101/127; 101/128.1; 101/129

[58] Field of Search ..... 101/127, 127.1, 101/128.1, 128.21, 128.4, 129

[56] References Cited

U.S. PATENT DOCUMENTS

| | | | |
|---|---|---|---|
| 538,066 | 2/1895 | Conde | 101/128.4 |
| 1,069,435 | 8/1913 | Krueger | 101/128.1 |
| 1,614,549 | 1/1927 | Gestetner | 101/128.1 |
| 1,861,260 | 5/1932 | Brasseur | 101/128.1 |
| 1,937,750 | 12/1933 | Elliott | 101/127.1 |
| 2,087,564 | 7/1937 | Alpert | 101/128.1 |
| 2,664,818 | 1/1954 | Heasley | 101/128.21 |
| 2,970,931 | 2/1961 | Gumbinner | 428/215 |
| 3,789,756 | 2/1974 | Weber | 101/128.1 |
| 4,128,057 | 12/1978 | Hayama et al. | 101/127 |
| 4,515,077 | 5/1985 | Davidson et al. | 101/127 |
| 5,720,220 | 2/1998 | Kodama et al. | 101/127.1 |

FOREIGN PATENT DOCUMENTS

| | | | |
|---|---|---|---|
| 319194 | 12/1988 | Japan | 101/127 |

*Primary Examiner*—Stephen R. Funk

*Attorney, Agent, or Firm*—Sughrue, Mion, Zinn, Macpeak & Seas, PLLC

[57] ABSTRACT

A stencil sheet unit includes a stencil sheet having a rectangular area and a mount paper substantially equal in configuration to the stencil sheet, wherein the stencil sheet is adhered in part onto the mount paper by an adhesive portion provided between the stencil sheet and the mount paper, wherein an area of the adhesive portion is smaller than half of the rectangular area of the stencil sheet, and a printing-preparation is made on a portion other than the adhesive portion of the stencil sheet.

9 Claims, 12 Drawing Sheets

STENCIL SHEET UNIT AND METHOD OF MAKING PRINT STENCIL USING THE SAME

BACKGROUND OF INVENTION

The present invention relates to a stencil sheet unit for a stencil printing apparatus in which a simplified system of stencil printing is conducted.

Conventionally, a thermo-sensitive printing-preparation and a UV printing-preparation are known as a method of making up a sheet of stencil on which a resin film and a porous support are adhered to each other. According to the thermo-sensitive printing-preparation, holes are formed on a resin film by means of heating conducted in such a manner that a thermal head is utilized or a carbon master, which has been put on the resin film, is irradiated with a high intensity of light. According to the UV printing-preparation, the resin film is hardened by ultraviolet rays, so that holes can be formed on the resin film. What is called a stencil printing-preparation has been known since olden times, in which a sheet of Japanese paper coated with wax is used as a sheet of stencil for stencil printing, and a ball-point pen or a steel pen is used to handwrite letters and illustrations on the stencil directly.

When the thermo-sensitive printing-preparation and the UV printing-preparation are used, it is possible to provide images of high quality. Therefore, the thermo-sensitive printing-preparation and the UV printing-preparation are the mainstream of the printing-preparation in the field of stencil printing. However, these systems are disadvantageous in that the equipment costs of both the stencil printing-preparation device and the printing device are relatively high, and further the size of the apparatus is increased. Concerning the stencil printing-preparation method conducted by a steel pen, although the printing quality is high, it requires great skill. Concerning the stencil printing-preparation method in which a ball-point pen and a sheet of stencil coated with wax are used, although the printing-preparation work is simple, it is impossible to provide an image of high printing quality.

SUMMARY OF INVENTION

It is an object of the present invention to provide a printing stencil unit in which the printing quality is high without any great skill, and a method of making a print stencil using the printing stencil.

In order to accomplish the above object, according to the first aspect of the present invention, there is provided a stencil sheet unit comprising: a stencil sheet having a rectangular area; a mount paper which is substantially equal in configuration to the stencil sheet, wherein the stencil sheet is adhered in part onto the mount paper; and an adhesive protion provided between the stencil sheet and the mount paper for adhering them to each other, wherein an area of the adhesive portion is smaller than half of the rectangular area of the stencil sheet, and printing-preparation is made on a portion other than the adhesive portion of the stencil sheet.

According to the second aspect of the invention, there is provided the stencil sheet unit according to the first aspect, wherein a boundary line is formed on the mount paper, to divide the mount paper into two sections.

According to the third aspect of the invention, there is provided the stencil sheet unit according to the second aspect, wherein a line of perforations is formed along the bound line.

According to the fourth aspect of the invention, there is provided the stencil sheet unit according to the first aspect, wherein the stencil sheet comprises: a porous support permitting ink to pass therethrough; and a film laminated with the porous support.

According to the fifth aspect of the invention, there is provided the stencil sheet unit according to the first aspect, wherein the stencil sheet comprises a film.

According to the sixth aspect of the invention, there is provided the stencil sheet unit according to the first aspect, wherein a plural number of the stencil sheet units are stacked into a stencil sheet stack.

According to the seventh aspect of the invention, there is provided the stencil sheet unit according to the first aspect, further comprising: a temporary adhesive spot for temporarily fixing the stencil sheet formed on the stencil sheet closer to an open side of the portion other than the adhesive portion.

According to the eighth aspect of the invention, there is provided a method for making a printing stencil by use of a stencil sheet unit in which a rectangular stencil sheet is adhered in part onto a mount paper substantially equal in configuration to the stencil sheet, and an adhesive portion of the stencil sheet is smaller than the half of the area of the stencil sheet, and a printing-preparation is made on a non-adhesive area of the stencil sheet, the method comprising: making the printing-preparation to be printed on a portion of the stencil sheet where the stencil sheet is not adhered to the mount paper; putting ink on the portion thus subjected to the printing-preparation in the non-adhesive portion of the stencil sheet; dividing the mount paper along a boundary line between an adhesive portion and a non-adhesive portion; and bending the stencil sheet along one side of the stencil sheet so as to wrap the ink therein, for enabling the stencil printing.

According to the ninth aspect of the invention, there is provided the method for making a printing stencil according to the eighth aspect, further comprising the step of: sticking the free end of the stencil sheet to the mount paper after the bending step.

According to the tenth aspect of the invention, there is provided the method for making a printing stencil according to the eighth aspect, wherein in the printing-preparation step, a plate like printing-preparation member having fine particle surfaces is inserted between the mount paper and the stencil sheet, and in this state, pressure is applied to the upper surface of the stencil sheet in a dot pattern fashion, to form perforations at positions of the stencil sheet where the stencil sheet receives the pressure in a dot pattern fashion.

According to the eleventh aspect of the invention, there is provided the method for making a printing stencil according to the tenth aspect, wherein the stencil sheet comprises a porous support permitting ink to pass therethrough and a film, both the porous support and the film being laminated together, and in the printing-preparation step, the surface of the film is put on a base plate to be brought into contact with the fine particle surface of the printing-preparation member, and pressure is applied to the porous support.

The printing-preparation member 10 is inserted into the non-adhesive region of the stencil unit 1. Desired characters or images to be printed are drawn with a writing tool from an upper surface of the porous support of the printing stencil 3. Due to the pressing force during the writing, a large number of fine holes are formed by the writing tool on the resin film 3*b* of the printing stencil 3 in accordance with the pattern corresponding to the characters or images drawn on the porous support 3*a*.

Ink 16 of a desired color is put in the image forming region in the unadhesive region on the printing stencil 3. The stencil unit 1 is folded along the perforations 2*a*, and the portion of the printing stencil 3 where it is folded and encloses ink 16 therein is adhered onto the mount paper 2.

The mount paper 2 is divided onto the long side and the short side at the perforations 2*a*, and then the printing-preparation and assembling are completed.

After that, the stencil unit 1 is stacked on the printing paper 30, and a uniform force is applied. The printing corresponding to the characters or images is printed on the printing paper 30.

BRIEF DESCRIPTION OF DRAWINGS

FIG. 2(*b*) is a partially enlarged view showing the stencil unit.

FIG. 20(*b*) is a diagram showing a characteristic of compression of the piece of sponge used for holding a sheet of paper.

DETAILED DESCRIPTION OF PREFERRED EMBODIMENTS

Embodiments of the stencil units according to the present invention is explained below.

Figure 1:
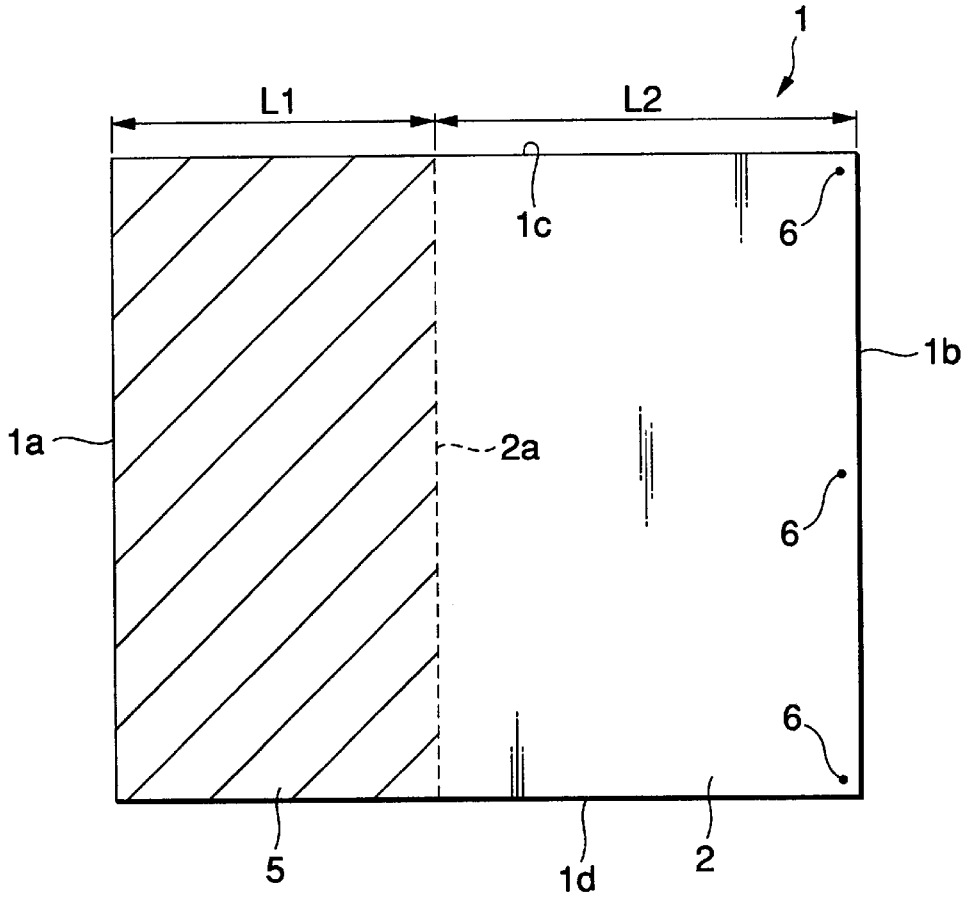
FIG. 1 is a plan view showing a stencil unit used in a stencil printing apparatus of an embodiment of the present invention.
Figure 2A:
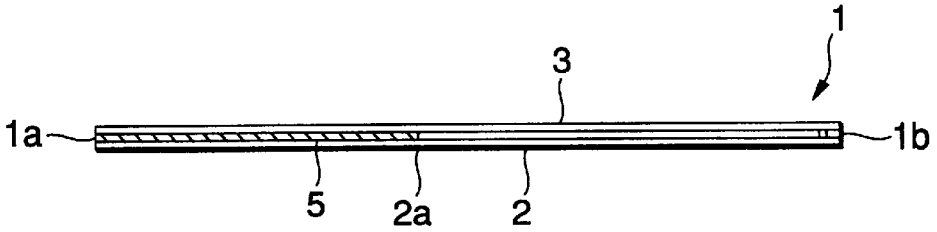
FIG. 2(*a*) is a side view showing a stencil unit.
Figure 2B:
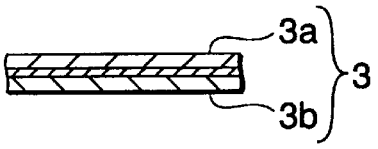

FIG. 1 is a plan view showing an embodiment of the stencil unit, and FIG. 2(*a*) is a side view showing an embodiment of the stencil unit.

As shown in FIG. 1, the stencil unit 1 has a base body of a substantially rectangular mount paper 2 of a predetermined thickness. This mount paper 2 is made of wood free paper. On the mount paper 2, there are provided perforations 2*a* which are formed at positions deviating from the center line of the mount paper 2. A distance of the perforations 2*a* from the end portion 1*a* is L1, and a distance of the perforations 2*a* from the end portion 1*b* is L2.

In this case, distances L1 and L2 are determined to be that distance L1<distance L2. On the short side with respect to the boundary of the perforations 2*a*, that is, in a portion between the end portion 1*a* and the perforations 2*a*, there is provided an adhesive section 5 which is a hatched portion in the drawing. This hatched portion in the drawing is an adhesive region to which the printing stencil 3 is adhered. An adhesive agent made of rubber is used in the adhesion.

Figure 25:
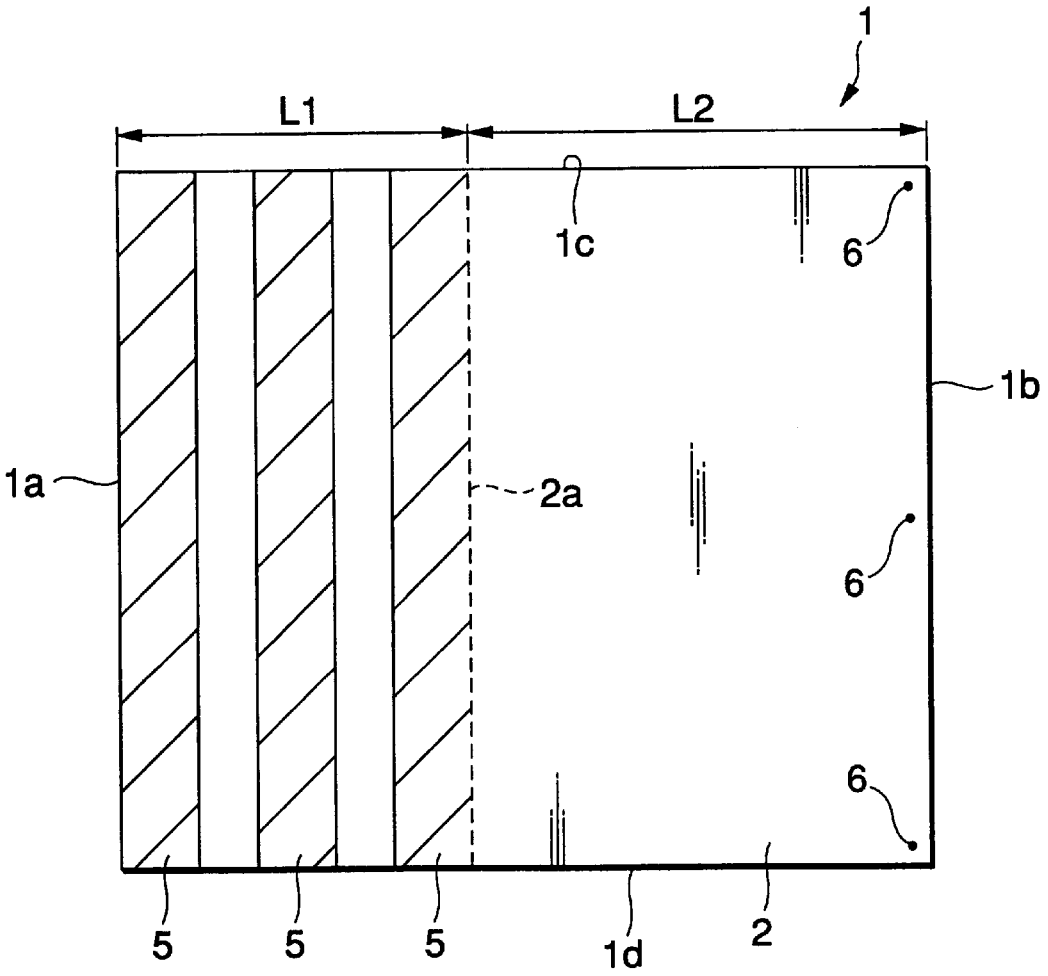
FIG. 25 is a plan view showing an example of another structure of the stencil unit.

In this connection, it is possible to divide the adhesive section 5 into several portions as shown in FIG. 25.

On the other hand, on the long side with respect to the boundary of the perforations 2*a*, there is provided a non-adhesive region. In this non-adhesive region, at positions close to the end portion 1*b* of the mount paper 2, there are provided a plurality of adhesive portions 6 used for temporary adhesion. An end portion of the printing stencil 3 is temporarily made to adhere so that it can not be mistakenly opened. An adhesive agent, the adhesive force of which is low, is used for these adhesive portions 6.

In this connection, the number of the adhesive portions for temporary adhesion may be only one. Alternatively, the adhesive portions used for temporary adhesion may be arranged in the shape of a belt.

As shown in FIG. 2(*b*), which is an enlarged cross-sectional view, the printing stencil 3 has a porous support 3*a* made of Japanese paper and a resin film 3*b*, which are made to adhere to each other. The resin film 3*b* of the printing stencil 3 faces the mount paper 2, and the porous support 3*a* faces outside.

Examples of the porous support 3*a* are: paper made of porous synthetic resin or natural fiber, paper made of mixed fiber in which porous synthetic resin and natural fiber are mixed with each other, various woven fabric, and non-woven fabric. It is preferable to use Japanese tissue. When the density of tissue is too high or the basis weight of tissue is too large, ink can not pass through appropriately in the process of printing. Therefore, it is impossible to conduct clear printing. Conversly, when the density is too low or the basis weight is too small, the printing property is deteriorated in the process of printing. Therefore, it is preferable that the basis weight is kept in a range from 5 g/m$^2$ to 25 g/m$^2$.

The resin film 3*b* is preferably made of PET (polyethylene terephthalate). It is preferable that the thickness of the resin film 3*b* be kept in a range from 0.9 $\mu$m to 7 $\mu$m. It is more preferable that the thickness of the resin film 3*b* be kept in a range from 2 $\mu$m to 3 $\mu$m. The most appropriate value is 2 $\mu$m in this emobdiment.

Figure 3:
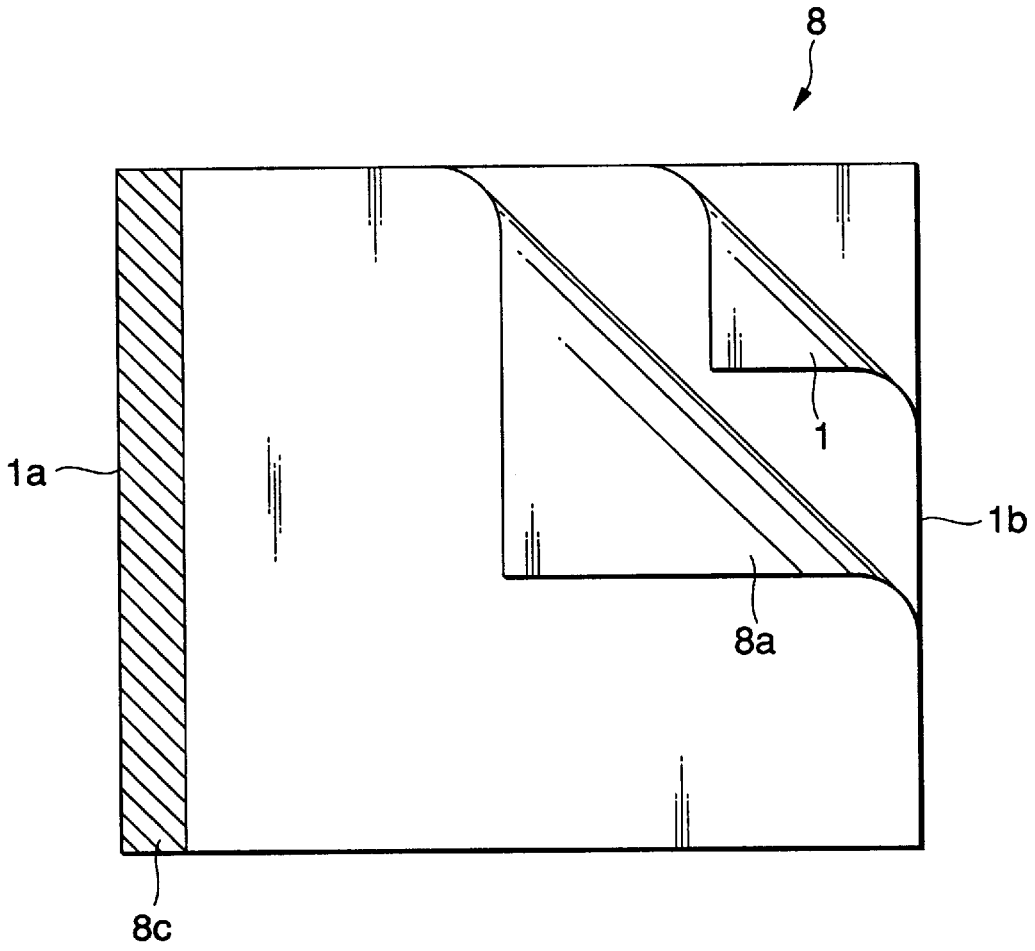
FIG. 3 is a plan view showing a bundle of sheets of stencil.
Figure 4:
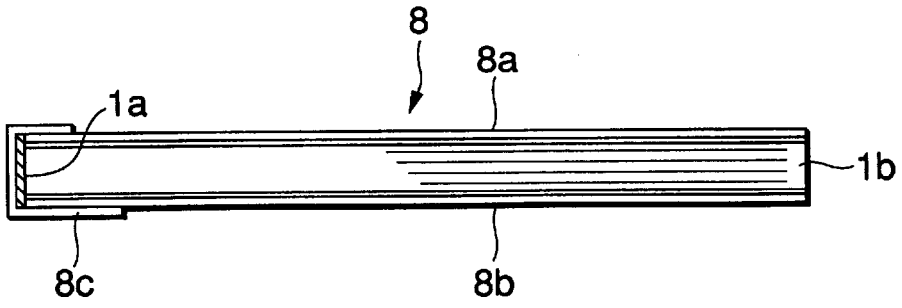
FIG. 4 is a side view showing a bundle of sheets of stencil.

FIG. 3 is a plan view and FIG. 4 is a side view, wherein both views show a bundle of sheets.

A plurality of sheets of stencil units 1 are bundled and formed in to a note-shape. In this way, the stencil units 1 are of a bundle 8. On the front and the back of the bundle 8 of sheets, there are respectively provided a cover 8*a* and a back cover 8*b*. The stencil unit 1, cover 8*a* and back cover 8*b* are made to adhere and fixed to the end portion 1*a* (the end portion of the adhesive region) on one side by adhesive. Further, a tape 8*c* is made to adhere to the end portions 1*a* of the cover 8*a* and the back cover 8*b*.

From an upper portion of the bundle 8 of sheets, the stencil unit 1 can be removed one by one.

Figure 5:
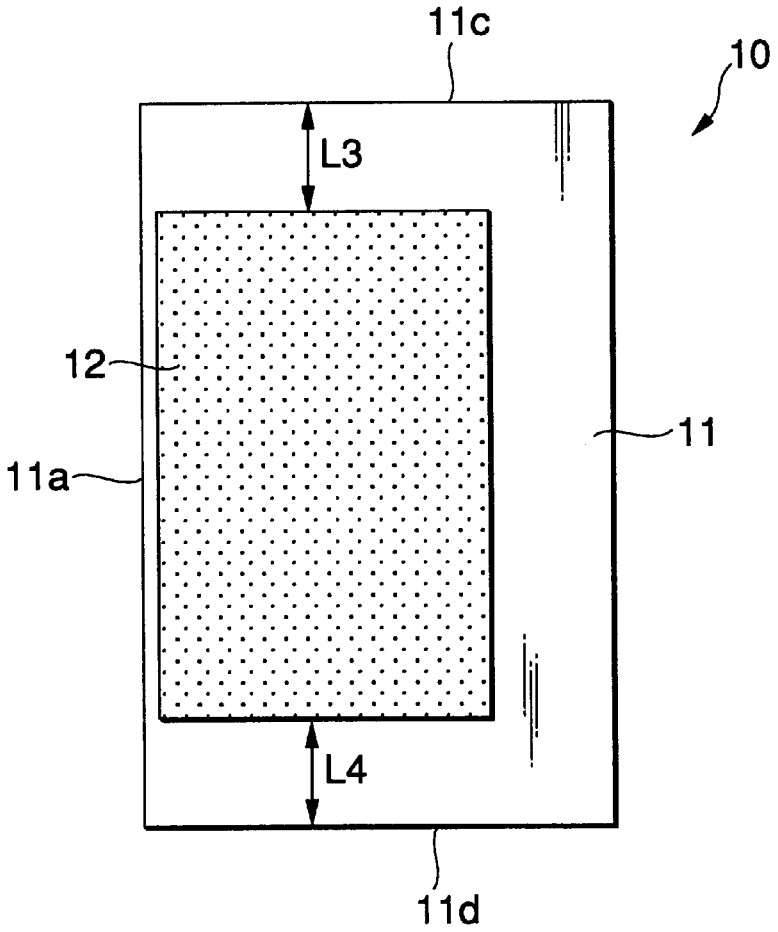
FIG. 5 is a plan view showing a printing-preparation member.
Figure 6:
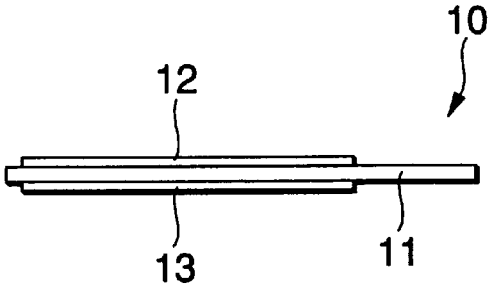
FIG. 6 is a side view showing a printing-preparation member.

FIGS. 5 and 6 are respectively a plan view and a side view showing a printing-preparation member 10.

The base 11 of the printing-preparation member 10 is made of plastics, and the outer diameter of the base 11 is approximately the same as that of the unadhesive region of the stencil unit 1. As described later, this printing-preparation member 10 is inserted between the mount paper 2 of one stencil unit 1 and the printing stencil 3.

On both sides of the base 11, there are provided particulate surfaces 12, 13 made of water-proof abrasive paper, the width and the length of which are predetermined. Regions on the particulate surfaces 12, 13 of this base 11 are image forming regions, which correspond to the printing surface position when simplified printing is conducted.

In the lateral direction, these particulate surfaces 12, 13 are close to one side 11*a* of the base 11, and in the longitudinal direction, these particulate surfaces 12, 13 are distant from both edges 11*c*, 11*d* of the base 11 by predetermined distances L3, L4.

On the particulate surfaces 12, 13, hard particulates are densely arranged overall in rectangular regions. Examples of material of the particulates are: silicon, aluminum oxide, silicon carbide and diamond. The mesh number of the particulates to be utilized is in a range from #30 to #4000. In this example, the mesh number of the particulates on the particulate surface 12 is #240, and the mesh number of the particulates on the particulate surface 13 is #600. The particulates are not spherical but squarish. The size of each particulate varies in a predetermined range, and the particulates are made to adhere to the base at random.

Particle sizes of the above particulates distribute in a range from a value lower than the above value by 10 to 20%, to a value higher than the above value by 10 to 20%. The mesh number # stipulates the maximum grain size of the particulates. For example, the mesh number #240 expresses the maximum grain size that has passed through a sieve having 240 meshes in one square inch in the longitudinal and the lateral direction.

These particulate surfaces 12, 13 are not limited to the above structure in which the particulates are made to adhere onto a sheet of hard paper. For example, the particulate surfaces may be provided in the following manner. A surface of metal such as iron is subjected to etching; a surface is subjected to electro-casting; and a surface is made of plastics by means of molding.

Next, a series of procedures of printing-preparation and assembling of the above stencil unit 1 will be explained below.

First, one sheet of stencil unit 1 is peeled off from a bundle of sheets of stencil 8.

Figure 7:
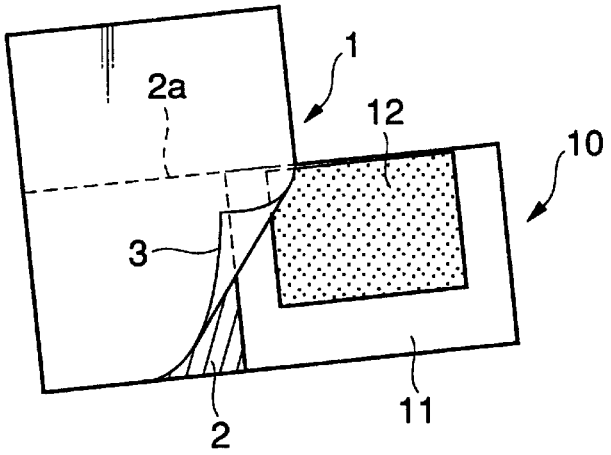
FIG. 7 is a view showing a procedure of printing-preparation of a stencil unit.

Then, as shown in FIG. 7, after the stencil unit 1 has been peeled off from the adhesive section 6 used for temporary adhesion, the printing-preparation member 10 is inserted into the non-adhesive region of the stencil unit 1 in the longitudinal direction, that is, the printing-preparation member 10 is inserted between the mount paper 2 and the printing stencil 3. In this case, a finishing state after the completion of printing can be changed by whether the particulate surface 12 or the particulate surface 13 is set upward. The following explanation will be made under the condition that the particulate surface 12 is set upward.

Figure 8:
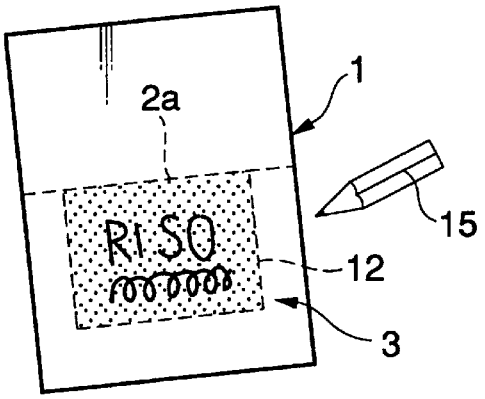
FIG. 8 is a view showing a procedure of printing-preparation of a stencil unit.

Next, as shown in FIG. 8, desired characters or images are drawn with a writing tool 15 in the image forming region on the particulate surface 12 of the printing-preparation member 10 from an upper surface of the porous support of the printing stencil 3. Since the printing stencil 3 is semi-transparent, the particulate surface 12 of the printing-preparation member 10 inserted onto a lower surface of this printing stencil 3 can be seen through. In this connection, in the middle of the process of drawing, the printing-preparation member 10 may be inverted, so that printing-preparation can be also conducted on the particulate surface 13.

Concerning the writing tool 15, it is possible to use a pencil or a strip of bamboo. Hardness of the pencil is in a range from 6B to 9H. It is preferable that hardness of the pencil is in a range from B to 4H. In this case, the harder the pencil is, the sharper and darker the characters or images become. The softer the pencil is, the lighter the characters or images become.

Since the characters or images to be subjected to printing-preparation are drawn on the porous support 3*a*, it is possible for a person to draw them while he visually recognizes them. Also, it is possible for him to make sure a portion in which the characters or images have been drawn.

The resin film 3*b* of the printing stencil 3 on the side of the particulate surface 12 is given pressure by the writing tool in accordance with the pattern drawn on the porous support 3*a*, so that the resin film 3*b* is pushed into among the hard particulates.

Due to the foregoing, a large number of fine holes are formed by the writing tool 15 on the resin film 3*b* of the printing stencil 3 in accordance with the pattern corresponding to the characters or images drawn on the porous support 3*a*.

The profiles and arrangements of the above fine holes correspond to those of the particulates on the particulate surface 12. That is, the profiles of the fine holes are respectively independent from each other, and further the fine holes are arranged at random. Since the fine holes are independently formed, set-off is seldom caused in the process of printing. Since the fine holes are formed at random, the obtained images are seldom affected by moire.

Figure 9:
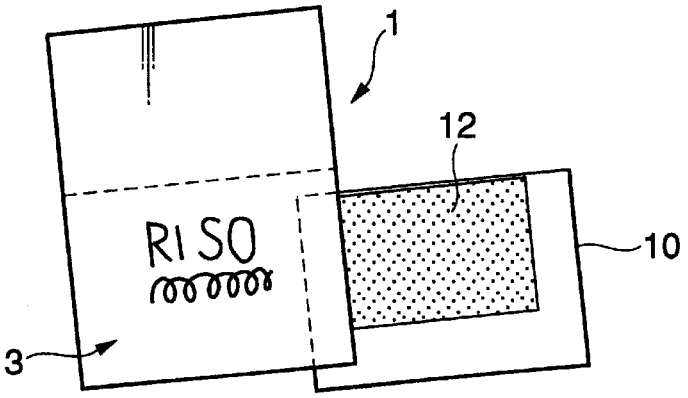
FIG. 9 is a view showing a procedure of printing-preparation of a stencil unit.

After printing-preparation has been completed, the printing-preparation member 10 is detached from the stencil unit 1 as shown in FIG. 9.

Figure 10:
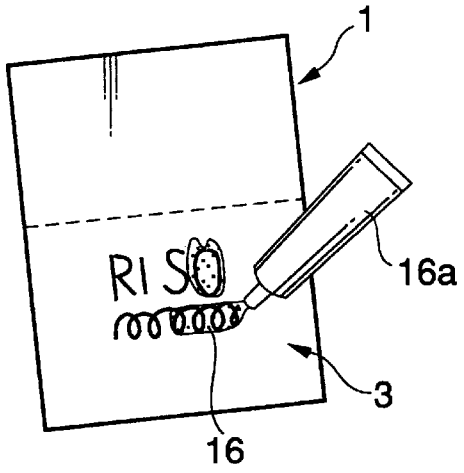
FIG. 10 is a view showing a state in which ink is put on a stencil unit.

Next, as shown in FIG. 10, ink 16 of a desired color is placed in the image forming region in the non-adhesive region on the printing stencil 3. Since traces of the writing tool 15 are left in the image forming region at this time, they can be visually recognized. Accordingly, positions at which ink must be placed can be easily found. The ink tube 16*a* is pressed, so that ink can be directly squeezed onto the region. This ink 16 is put on the porous support 3*a* of the printing stencil 3.

Figure 11:
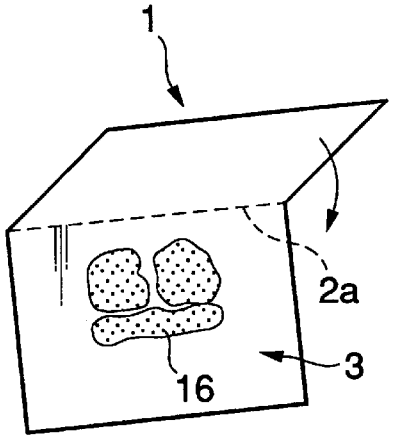
FIG. 11 is a view showing a procedure of assembling a stencil unit.

Next, as shown in FIG. 11, the stencil unit 1 is folded along the perforations 2*a* by the angle of 180° in a direction so that the sheets of the printing stencil 3 can be contacted with each other. In this way, ink 16 can be enclosed inside the printing stencil 3.

Figure 12:
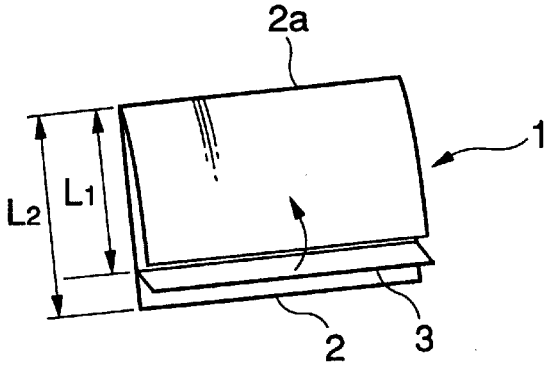
FIG. 12 is a view showing a procedure of assembling a stencil unit.

When the stencil unit 1 is folded in this way, the short side of the stencil unit 1 is put on the long side as shown in FIG. 12. Accordingly, end portions of the mount paper 2 on the long side and the printing stencil 3 are exposed onto the upper surface by a predetermined length. Only the printing stencil 3, which has been exposed in this way, is folded by the angle of 180° so that it can be put on the end portion of the mount paper 2 on the short side.

Figure 13:
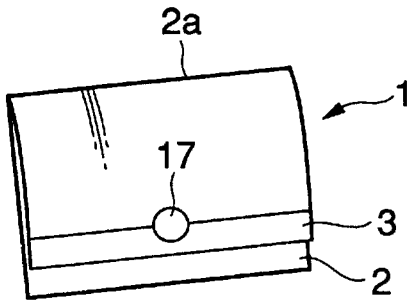
FIG. 13 is a view showing a procedure of assembling a stencil unit.

Next, as shown in FIG. 13, this folded portion of the printing stencil 3 is made to adhere onto the mount paper 2. It is possible to use an adhesive seal 17 in this adhesion as shown in the drawing.

Figure 14:
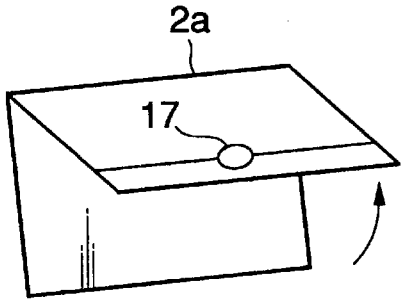
FIG. 14 is a view showing a procedure of assembling a stencil unit.
Figure 15:
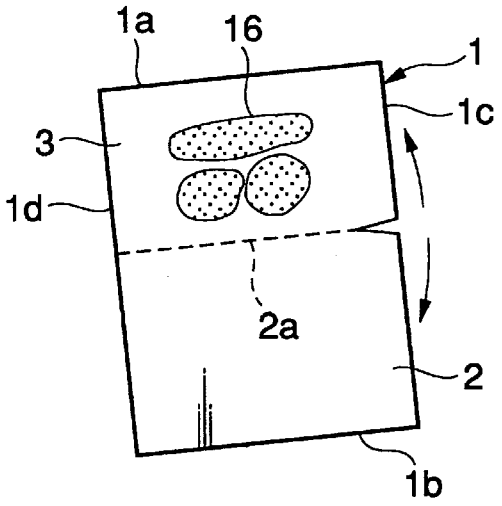
FIG. 15 is a view showing a procedure of assembling a stencil unit.

Next, as shown in FIG. 14, the stencil unit 1, which has been folded in the manner described above, is folded back along the perforations 2*a* in the direction opposite to the above folding direction. After that, as shown in FIG. 15, the mount paper 2 is divided onto the long side and the short side at the perforations 2*a*.

In this way, the assembly of the stencil unit 1 is completed.

Figure 16:
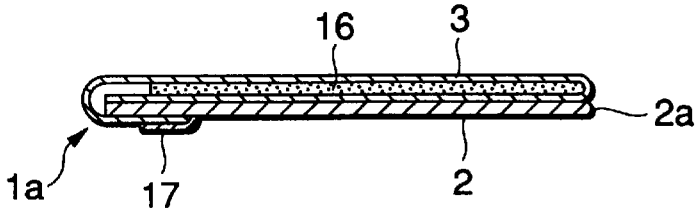
FIG. 16 is a cross-sectional side view showing a stencil unit after the completion of printing-preparation and assembling.

FIG. 16 is a cross-sectional side view of the stencil unit 1 in which the above assembly has been completed.

The resin film 3*b* side of this stencil unit 1 is set on a sheet of printing paper, and a uniform pressure is applied onto the entire surface. Then, ink 16 passes through the porous support 3*a* and the printing-preparation section of the resin film 3*b*, and is transferred onto the sheet of printing paper, so that a printing image corresponding to the printing-preparation pattern can be formed on the sheet of printing paper.

In the above assembling condition, sheets of the printing stencil 3 of the stencil unit 1 may be only folded to each other at the open end portions 1*c*, 1*d* shown in FIGS. 1 and 15, that is, sheets of the printing stencil 3 of the stencil unit 1 may not be made to adhere to each other. The detail will be described later.

Next, the structure of the stencil printing apparatus of the present invention will be explained below.

Figure 17:
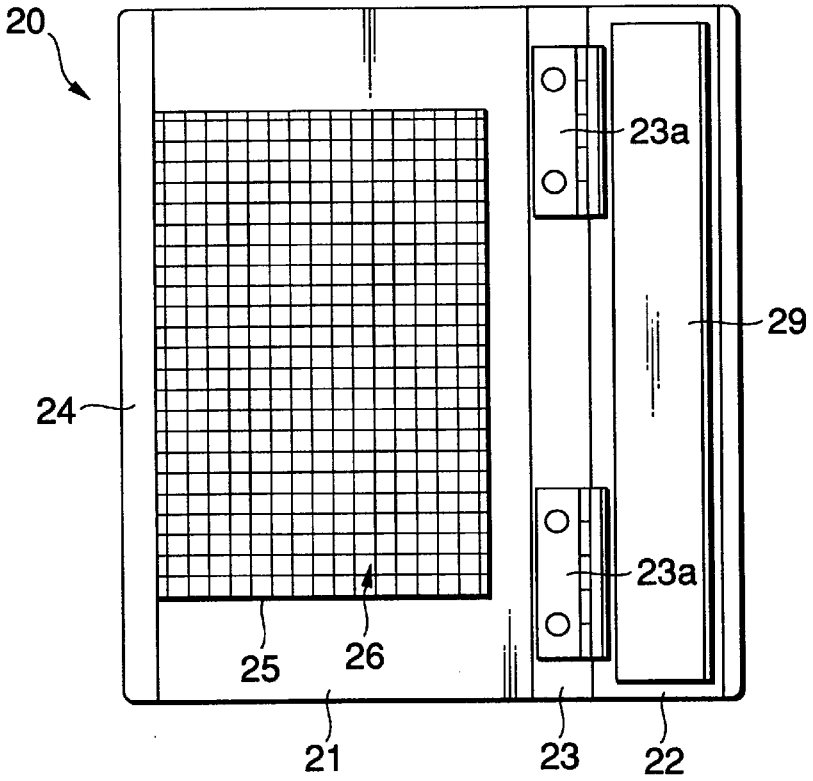
FIG. 17 is a plan view showing a stencil printing apparatus according to an embodiment of the present invention.
Figure 18:
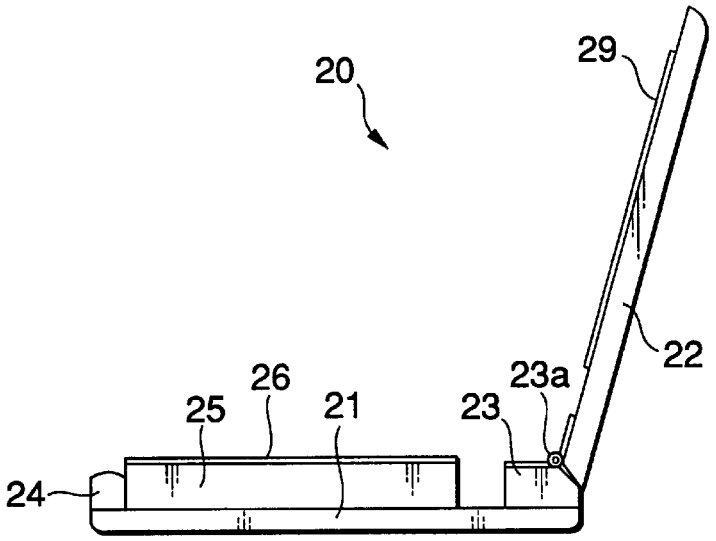
FIG. 18 is a side view showing the stencil printing apparatus according to the embodiment of the present invention.
Figure 19:
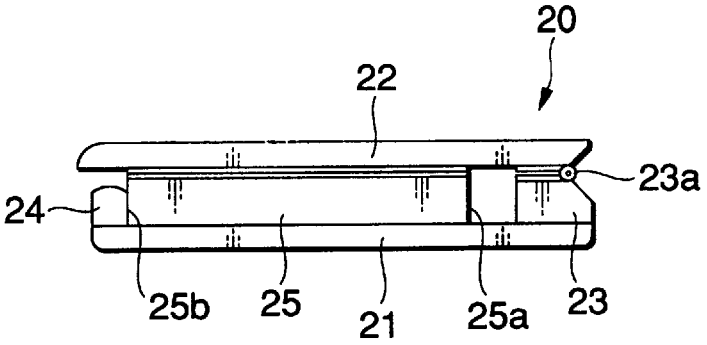
FIG. 19 is a side view showing a state in which the pressure plate of the stencil printing apparatus is closed.

FIG. 17 is a plan view showing a stencil printing apparatus in which the stencil unit 1 is used after the completion of printing-preparation and assembling. FIG. 18 is a side view of the stencil printing apparatus. FIG. 19 is a side view of the stencil printing apparatus in a state in which the pressure plate is closed.

In the apparatus 20, the pressure plate 22 is provided such that the pressure plate 22 can be opened and closed with respect to the base plate 21 arranged on a working table. On the base plate 21, there is arranged a spacer member 23 of a predetermined height along one long side of the base plate 21. Accordinglyl, the pressure plate 22 can be freely opened and closed via the hinge 23*a* arranged on the spacer member 23.

On the upper surface of the base plate 21, there is provided a piece of sponge 25 of a predetermined thickness to which is used as a pedestal to hold a sheet of printing paper when printing is conducted. On the upper surface of the piece of sponge 25, there is provided an adhesive sheet 26 which is an adhesive member for holding a sheet of printing paper.

The size of this piece of sponge 25 is the same as that of the sheet of printing paper. The profile of this piece of sponge 25 coincides with that of the particulate surface 12 on the printing-preparation member 10, or alternatively the profile of this piece of sponge 25 is a little larger than that of the particulate surface 12 on the printing-preparation member 10.

At a position corresponding to the piece of sponge 25 on the pressure plate 22, there is provided an adhesive sheet 29 for holding a sheet of stencil which is an adhesive member for holding the stencil unit 1 after printing-preparation.

The profile of this adhesive sheet 29 coincides with that of the stencil unit 1 after printing-preparation shown in FIG. 16.

In this case, the size of the adhesive sheet 29 in the longitudinal direction is larger than that of the piece of sponge 25. That is, in the stencil unit 1, the open end portions 1*c*, 1*d* are formed at positions distant from the image forming region by a predetermined distance while the image forming region is located at the center of the open end portions 1*c*, 1*d*. The length of the stencil printing unit 1 in the longitudinal direction is relatively longer than the length of the object to be printed (the printing paper) 30.

Heights of the spacer member 23 and the piece of sponge 25 are determined so that the pressure plate 22 can be kept in parallel with the base plate 21 when the pressure plate 22 is closed under the condition that no urging force is applied from an upper portion.

On the other long side of the base plate 21, that is, on the open end side of the pressure plate 22, there is provided a rod-shaped compression receiving member 24, the height of which is predetermined so that it can be used as a compression amount setting means. This apparatus 20 conducts printing when the pressure plate 22 is rotated round the hinge 23*a*. Therefore, the height of the compression receiving member 24 is smaller than the height of the spacer member 23 so that the piece of sponge 25 can be compressed by a predetermined amount.

The height of this compression receiving member 24 is determined according to the compression characteristic of the sponge 25.

Figure 20A:
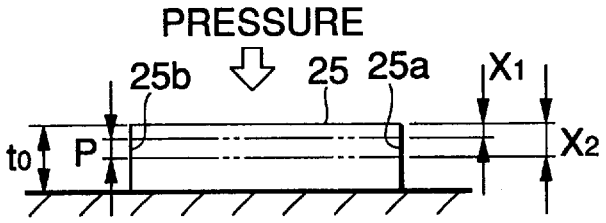
FIG. 20(*a*) is a side view showing a piece of sponge used for holding a sheet of paper.
Figure 20B:
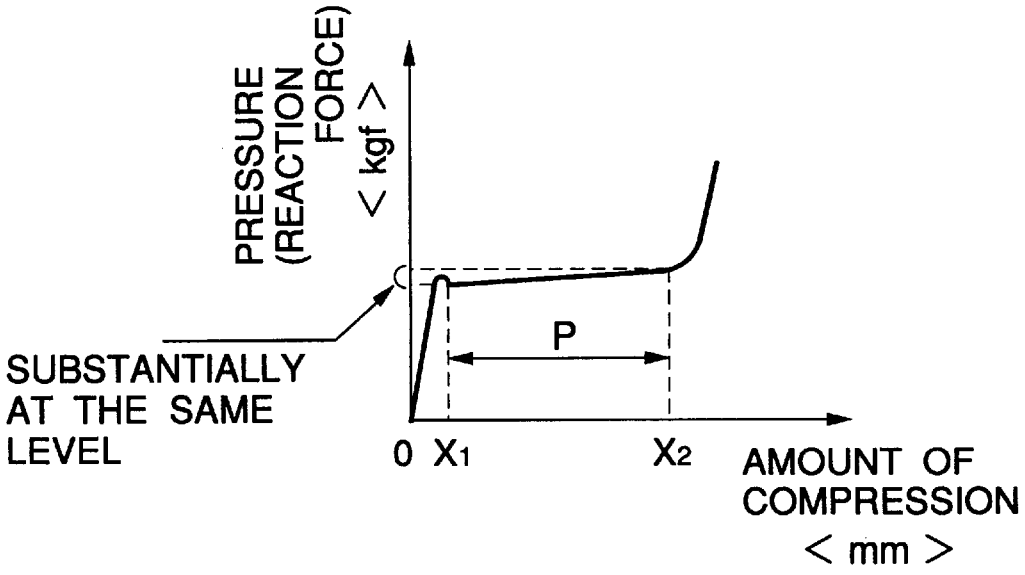

FIG. 20(*a*) is a side view of the piece of sponge 25. FIG. 20(*b*) is a diagram showing, the compression characteristic of the piece of sponge 25. In FIG. 20(*b*), the horizontal axis expresses an amount of compression (mm), and the vertical axis expresses a pressure (kgf).

This piece of sponge 25 is made of urethane foam. This sponge is characterized in that: when an upper surface of the piece of sponge is uniformly compressed at a constant rate, pressure (reaction force) remains on the substantially same level or increases only a little.

Therefore, in the present invention, the height of the compression receiving member 24 is determined so that the urging force given to the piece of sponge 25 can be kept in a range P in which the urging force increases only a little.

Figure 21:
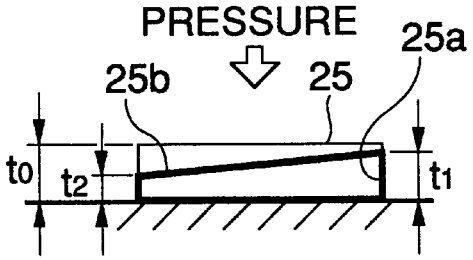
FIG. 21 is a side view showing a state of compression of a piece of sponge used for holding a sheet of paper.

That is, as shown in the side view of FIG. 21, when the piece of sponge 25 is not given a compression force, the height of the piece of sponge 25 from the surface of the base plate 21 is a predetermined value $t_0$, and when the piece of sponge 25 is compressed, the piece of sponge 25 is inclined as shown by a solid line in the drawing by the action of the pressure plate 22 rotated round the hinge 23*a*. In this case in which the piece of sponge 25 is compressed, the height of one side of the piece of sponge 25 is $t_1$, and the height of the other side of the piece of sponge 25 is $t_2$.

In order to keep an amount of compression of the compression receiving member 25 in the characteristic range P, an amount of compression $t_0-t_1$ at one side portion 25*a* must satisfy the inequality of $t_0-t_1 \geqq X_1$, and further an amount of compression $t_0-t_2$ at the other side portion 25*b* must satisfy the inequality of $t_0-t_2 \leqq X_2$. The amount of compression is determined so that these two expressions can be satisfied. In this case, $t_2$ is the height of the compression receiving member 24.

In this case, the overall piece of sponge 25 is arranged as close as possible to the open end side on the base plate 21 so that the height of one side portion 25*a* of the piece of sponge 25 can be a value not higher than $t_1$ in the process of compression. In accordance with that, the adhesive sheet 29 opposed to the piece of sponge 25 is also arranged close to the one end side of the pressure plate 22.

Next, printing operation of the above stencil printing apparatus 20 will be explained.

The apparatus 20 is set on a working table under the condition that the base plate is placed downward.

Figure 22:
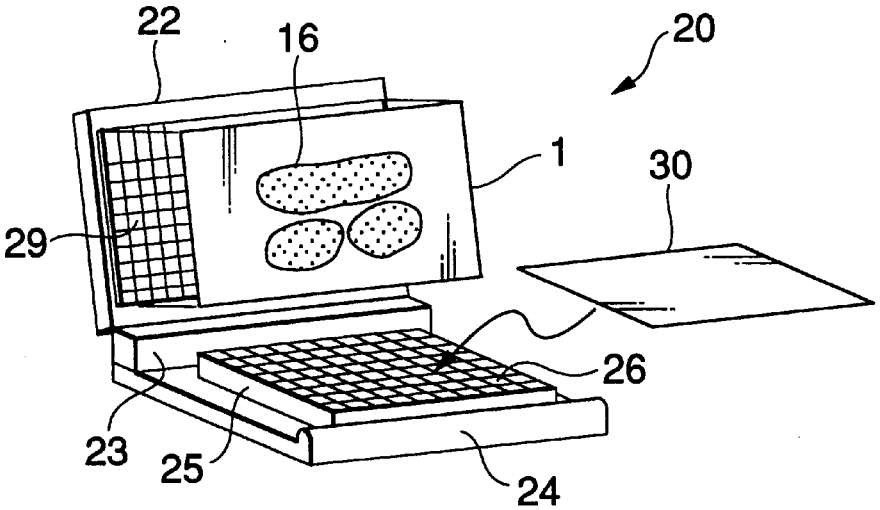
FIG. 22 is a perspective view showing a procedure of printing of a stencil printing apparatus.

Next, as shown in FIG. 22, the stencil unit 1, the printing-preparation and assembling of which have been completed, is made to adhere onto the adhesive sheet 29 for holding the sheet of stencil. In this case, the resin film 3*b* side of the stencil unit 1 is set on the front side.

In this case, the sheet of printing paper 30 is held on the adhesive sheet 26 arranged on the piece of sponge 25 which is used for holding a sheet of paper.

In this case, the size of the adhesive sheet 29 coincides with that of the stencil unit 1, and the sheet of printing paper 30, the size of which coincides with that of the pieces of sponge 25, is used. The stencil unit 1 is made to adhere onto the adhesive sheet 29 in such a manner that the edge portion of the stencil unit 1 coincides with that of the adhesive sheet 29, and the printing paper 30 is made to adhere to the piece of sponge 25 in such a manner that the edge portion of the printing paper 30 coincides with that of the piece of sponge 25. Due to the foregoing, the occurrence of misregistration can be prevented.

Figure 23:
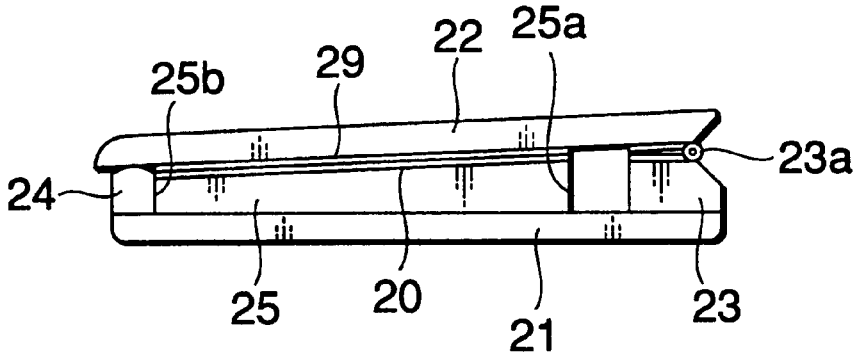
FIG. 23 is a side view showing a procedure of printing of a stencil printing apparatus.

After that, the pressure plate 22 is rotated toward the base plate 21, and the stencil unit 1 is pushed against the printing paper 30 as shown in FIG. 23. At this time, the urging force is applied until the open end portion of the pressure plate 22 comes into contact with the compression receiving member 24.

Due to the foregoing, ink 16 is transferred from the stencil unit 1 onto the sheet of printing paper 30. In this way, stencil printing is conducted on the sheet of printing paper 30 in accordance with an image to be formed.

At this time, one end portion 25*a* of the piece of sponge 25 is pushed by the compression receiving member 24 to a height not more than $t_1$, and the other end portion 25*b* of the piece of sponge 25 is pushed by the compression receiving member 24 to a height not less than $t_2$. Therefore, a reaction force of the piece of sponge 25 is kept in the characteristic range P in which the urging force increases only a little. In this way, the overall surface of the sheet of printing paper 30 and that of the stencil unit 1 can be tightly contacted with each other by uniform pressure.

At this time, the urging force of the pressure plate 22 is determined so that the urging force 22 can be contacted with the pressure receiving member 24. Even if the pressure plate 22 is strongly pushed, the compression force is restricted by the compression receiving member 24. Therefore, a quantity of ink to be transferred can be kept constant at all times, and printing quality can be made uniform.

This embodiment utilizes a sponge pad, the pressure of which can be kept at 10 kgf in the compression range from 1 to 7 mm, wherein the height to of the piece of sponge 25 in the case of non-compression is $t_0$=15 mm, $X_1$=1 mm, and $X_2$=7 mm. When this sponge pad is compressed so that $t_1$=13 mm and $t_2$=9 mm, the following two expressions are satisfied.

$$15(t_0)-13(t_1)=2 \geqq 1(X_1)$$

$$15(t_0)-9(t_2)=6 \leqq 7(X_2)$$

In this connection, when pressure is applied to the stencil unit 1 with respect to the sheet of printing paper 30, ink 16 accommodated in the stencil unit 1 flows in the stencil unit 1. Concerning the stencil unit 1, the stencil sheets 3 may be only folded with each other at the open end portions 1*c*, 1*d* (shown in FIG. 15) in the assembled condition, that is, the stencil sheets 3 may not be made to adhere to each other. That is, the size the image forming region in the stencil unit 1 is the same as that of the particulate surface 12 on the printing-preparation member 10, which is also the same as the size of the piece of sponge 25 (the printing paper 30) or alternatively a little smaller than the size of the piece of sponge 25. Therefore, even if ink 16 spreads when a compressive force is applied to the stencil printing unit 1 in the process of printing, leakage of ink to the outside can be prevented because the open end portions 1*c*, 1*d* are spaced from this image forming region by a predetermined distance.

In this connection, these open end portions 1*c*, 1*d* may be made to adhere so that the flow of ink 16 can be minimized.

In the process of printing, the stencil unit 1 can conduct printing under a simply assembled condition in which the printing stencils 3 are folded. In this stencil unit 1, there is provided no frame for holding the printing stencils 3. Accordingly, redundant protrusions and recesses are not formed, and the overall surface can be uniformly pressed by the simple structure.

Figure 24:
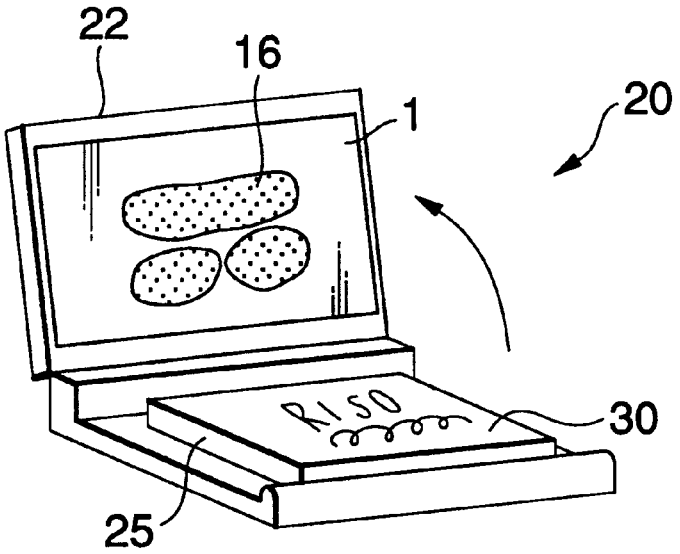
FIG. 24 is a perspective view showing a procedure of printing of a stencil printing apparatus.

Next, as shown in FIG. 24, when the pressure plate 22 is rotated in a direction so that the pressure plate 22 can be separated from the base plate 21, the stencil unit 1 can be separated from the sheets of printing paper 30. The sheets of printing paper 30 are held by the adhesive sheet 26 for holding sheets of paper, and the stencil unit 1 is held by the adhesive sheet 29 for holding stencil. Therefore, the sheets 30 of printing paper and the stencil unit 1 can be easily separated from each other. A printing image corresponding to a pattern drawn in the image forming region in the process of printing-preparation can be formed on the sheet 30 of printing paper.

This printing operation corresponds to the profiles and arrangements of the particulates on the particulate surface 12 in the process of printing-preparation of the printing stencil 3. That is, the profiles of the fine holes are respectively independent from each other, and further the fine holes are arranged at random. Since the fine holes are independently formed, set-off is seldom caused in the process of printing. Since the fine holes are formed at random, the obtained images are seldom affected by moire.

When the particulate surface 13 side of the printing-preparation member 10 is used in the process of printing-preparation, a state of printing-preparation is changed by the particulates of a different size. In accordance with that, a finishing state can be also changed.

In each example described above, the printing stencil 3 of the stencil unit 1 comprises a porous support 3*a* and a resin film 3*b* which are made to adhere to each other, however, it is possible to use only the resin film 3*b* for the printing stencil 3.

When the resin film 3*b* is thick, it is necessary to increase the grain size of the particulates on the particulate surfaces 12, 13. In this case, since holes composing the printing-preparation region on the resin film 3*b* are relatively large, it is preferable to use ink 16, the viscosity of which is rather high. When the resin film 3*b* is thin, it is necessary to decrease the grain size of the particulates on the particulate surfaces 12, 13. In this case, since holes composing the printing-preparation region on the resin film 3*b* are relatively small, it is preferable to use ink 16, the viscosity of which is rather low. When holes composing the printing-preparation region on the resin film 3*b* are relatively small, a quantity of ink transferred from the holes in the printing-preparation region onto the sheet of printing paper 30 is small. Therefore, even if the sheets of printing paper are put on each other immediately after printing, set-off of ink seldom occurs.

In the above embodiment, images are directly drawn with writing tool 15 on the printing stencil 3 of the stencil unit 1. However, the present invention is not limited to the above specific embodiment. When an original document is placed on an upper surface of the printing stencil 3 and an image on the original document is traced with the writing tool 15 from the upside of the original document, it is possible to conduct copying; printing-preparation and printing faithfully to the original document.

There are provided perforations 2*a* on the boundary line of the mount paper 2. However, the present invention is not limited to the above specific embodiment. It is possible to adopt an arrangement in which a boundary line to divide the mount paper 2 into two pieces is printed. In this case, the mount paper 2 may be cut off along the boundary line with scissors.

In the stencil printing apparatus 20 of this embodiment, the sheet of printing paper 30 is placed on the piece of sponge 25 on the base plate 21, and one-side printing is conducted on this sheet of printing paper 25. However, the stencil unit 1, which has been assembled, may be placed on the piece of sponge 25.

Due to the foregoing, the stencil units 1 are respectively attached to the adhesive sheet 29 of the pressure plate 22 and the piece of sponge 25 of the base plate 21. When the sheet of printing paper 30 is interposed between the stencil units 1, the pressure plate 22 is once closed. Due to the foregoing, printing can be simultaneously conducted on both sides of the sheet of printing paper 30.

In this connection, in the stencil unit 1 shown in FIGS. 1 to 3, the printing stencil 3 is provided on the overall surface of the mount paper 2. When the above arrangement is adopted, the printing stencil 3 functions as a back sheet which covers ink 16 on the printing stencil 3 that has been subjected to printing-preparation. Therefore, the above arrangement is advantageous in that the material of the mount paper 2 is not limited.

Figure 26:
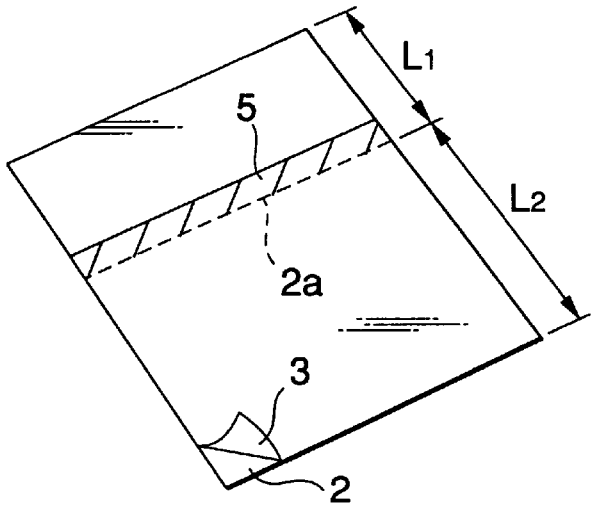
FIG. 26 is a perspective view showing an example of still another structure of the stencil unit.
Figure 27:
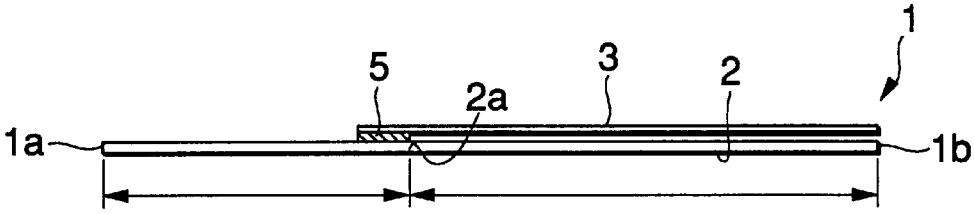
FIG. 27 is a side view showing the stencil unit.
Figure 28:
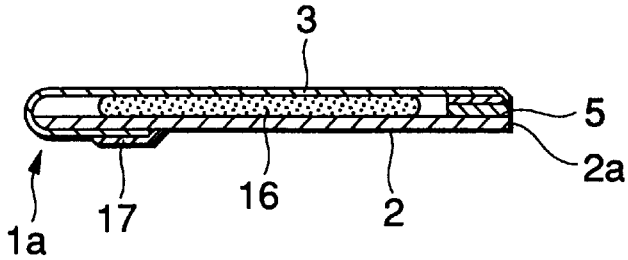
FIG. 28 is a cross-sectional side view showing a state in which the stencil unit is subjected to printing-preparation and assembling.

For example, the stencil unit 1 shown in FIGS. 26 and 27 is an embodiment in which a portion of the printing stencil 3 in the adhesive section 5 of the stencil unit 1 is cut out. When the above stencil unit 1 is subjected to printing-preparation and assembled, a portion corresponding to the back sheet of ink 16 is the mount paper 2 as shown in FIG. 28. For the above reasons, it is necessary that the mount paper 2 of this stencil unit 1 is made of laminated paper or plastics which can not be affected by ink, for example, it is impossible to use wood free paper.

According to the present invention, the stencil is adhered in part onto the mount paper, and the area of the adhesive portion is smaller than a half of the area of the stencil. Therefore, the printing-preparation is performed on the non-adhesive portion of the stencil, the mount paper is divided during enclosing ink, and the stencil is folded along the mount paper thus divided, so that the printing-preparation can be made, put ink thereon, and assembled.

The printing stencil is obtained such that the stencil is put onto on the particulate surface of the plate printing-preparation member, and given a pressing force via a writing tool. Therefore, the high quality printing is easily performed without any great skill.

Power sources or irradiation lamps necessary in the thermo-sensitive printing-preparation are not required any more. Therefore, the location of making a printing stencil is not limited, as well as the cost thereof is reduced. Futhermore, sketching, for instance, at outdoor serves printing-preparation process by itself, so that the print preparation process is simplified.

Futhermore, the stencil unit is made without much cost because the stencil unit comprises a mount paper and a stencil. It is easy to bundle a lot of the units and to carry them.

What is claimed is:

1. A stencil sheet unit comprising:

a stencil sheet having a rectangular area;

a mount paper substantially equal in configuration to the stencil sheet, the stencil sheet being partially adhered to the mount paper; and an adhesive portion provided between the stencil sheet and the mount paper for adhering the stencil sheet to the mount paper, where an area of the adhesive portion is slightly smaller than half of the rectangular area of the stencil sheet, and a printing-preparation is made on a printing portion of the stencil sheet other than the adhesive portion of the stencil sheet.

2. The stencil sheet unit according to claim 1, wherein a perforated boundary line is formed on the mount paper at an edge of said adhesive portion, to divide the mount paper into two sections.

3. The stencil sheet unit according to claim 1, wherein the stencil sheet comprises:

a porous support permitting ink to pass therethrough; and a film laminated with the porous support.

4. The stencil sheet unit according to claim 1, wherein the stencil sheet comprises a film.

5. The stencil sheet unit according to claim 1, further comprising:

a temporary adhesive spot for temporarily fixing the printing portion of the stencil sheet to the mount paper.

6. A method for making a printing stencil by use of a stencil sheet unit in which a rectangular stencil sheet is partially adhered onto a mount paper substantially equal in configuration to the stencil sheet, and an adhesive portion of the stencil sheet is smaller than half of the area of the stencil sheet, and a printing-preparation is made on a non-adhesive portion of the stencil sheet, the method comprising:

making the printing-preparation on the non-adhesive portion of the stencil sheet;

putting ink on the non-adhesive portion thus subjected to the printing-preparation;

dividing the mount paper along a boundary line between the adhesive portion and the non-adhesive portion; and folding the stencil sheet upon itself so as to enclose the ink.

7. The method for making a printing stencil according to claim 6, further comprising the step of:

adhering a free end of the stencil sheet to the mount paper after the folding step.

8. The method for making a printing stencil according to claim 6, wherein in the printing-preparation step, a printing-preparation member having fine particle surfaces is inserted between the mount paper and the stencil sheet, and in this state, pressure is applied to an upper surface of the stencil sheet in a dot pattern fashion, to form perforations at positions of the stencil sheet where the stencil sheet receives the pressure.

9. The method for making a printing stencil according to claim 8, wherein the stencil sheet comprises a porous support permitting ink to pass therethrough and a film, both the porous support and the film being laminated together, and in the printing-preparation step, the surface of the film is placed on the fine particle surface of the printing-preparation member, and pressure is applied to the porous support.

* * * * *